US007058987B2

(12) United States Patent
Salazar

(10) Patent No.: US 7,058,987 B2
(45) Date of Patent: Jun. 13, 2006

(54) UTILITY PANTS FOR LAW ENFORCEMENT PERSONNEL

(75) Inventor: Joseph Salazar, Antioch, CA (US)

(73) Assignee: Bullet 50, Antioch, CA (US)

( * ) Notice: Subject to any disclaimer, the term of this patent is extended or adjusted under 35 U.S.C. 154(b) by 112 days.

(21) Appl. No.: 10/672,206

(22) Filed: Sep. 26, 2003

(65) Prior Publication Data

US 2005/0066424 A1 Mar. 31, 2005

(51) Int. Cl.
*A41D 27/20* (2006.01)

(52) U.S. Cl. ..... 2/247; 2/227

(58) Field of Classification Search ..... 2/247, 2/94, 102, 69, 227, 23, 238, 79, 228, 248–254; 224/911, 192, 198, 660, 230
See application file for complete search history.

(56) References Cited

U.S. PATENT DOCUMENTS

| | | | | | |
|---|---|---|---|---|---|
| 198,287 | A | | 12/1877 | Flood | |
| 346,691 | A | * | 8/1886 | Searley | 2/231 |
| 738,168 | A | | 9/1903 | Delavoye | |
| 1,039,040 | A | | 9/1912 | Elder | |
| 1,083,942 | A | | 1/1914 | Plett | |
| 1,212,513 | A | * | 1/1917 | Langerman | 2/94 |
| 1,466,330 | A | * | 8/1923 | Cindel | 24/10 A |
| 1,726,951 | A | | 9/1929 | Evanove | |
| 1,780,356 | A | | 11/1930 | Liberman | |
| 1,827,585 | A | | 10/1931 | Kautz | |
| 2,078,461 | A | * | 4/1937 | Siegel | 2/93 |
| 2,285,692 | A | | 6/1942 | Wickman | |
| 2,521,410 | A | * | 9/1950 | Rosen | 2/227 |
| 2,663,876 | A | | 12/1953 | Miller et al. | |
| 2,762,054 | A | | 9/1956 | Smith | |
| 2,778,026 | A | | 1/1957 | Rosenthal | |
| 2,810,132 | A | | 10/1957 | Nicholson | |
| 2,930,046 | A | | 3/1960 | Sagner | |
| 3,320,620 | A | * | 5/1967 | Weidler et al. | 2/250 |
| 3,538,512 | A | | 11/1970 | Dolan | |
| 3,777,313 | A | | 12/1973 | Bergsten et al. | |
| 3,968,522 | A | | 7/1976 | Riess | |
| D281,636 | S | | 12/1985 | Cressy-Renoma | |
| 4,860,388 | A | * | 8/1989 | Dean | 2/247 |
| 4,969,214 | A | * | 11/1990 | Cohen | 2/94 |
| 5,054,127 | A | * | 10/1991 | Zevchak | 2/247 |
| 5,127,565 | A | * | 7/1992 | Grant | 224/196 |
| 5,136,722 | A | | 8/1992 | Moritzen | |
| 5,509,147 | A | * | 4/1996 | Busquets | 2/253 |
| 5,517,696 | A | | 5/1996 | Krugler | |
| 5,588,154 | A | * | 12/1996 | Blauer et al. | 2/69 |
| 5,884,332 | A | | 3/1999 | Snedeker | |
| 5,884,338 | A | * | 3/1999 | Golde | 2/247 |

(Continued)

FOREIGN PATENT DOCUMENTS

JP 11-012813 * 1/1999

*Primary Examiner*—Alissa L. Hoey
(74) *Attorney, Agent, or Firm*—Fulwider Patton LLP; Scott R. Hansen

(57) ABSTRACT

A pair of utility pants for use by law enforcement personnel includes one or more internal front pockets located within an outer front pocket of the wearer, the internal front pockets being suitably dimensioned for carrying respective ammunition clips; an internal hip pocket located within an outer hip pocket, the internal hip pocket being suitably dimensioned for carrying a pair of handcuffs; a baton pocket located along the thigh of the wearer for carrying a collapsible law enforcement baton; and a pocket sewn inside the waistband for carrying a handgun.

4 Claims, 4 Drawing Sheets

U.S. PATENT DOCUMENTS 6,088,831 A * 7/2000 Jensen et al. ..... 2/2.5
6,148,443 A 11/2000 Maastricht
6,260,209 B1 7/2001 St. Ange
6,769,139 B1 * 8/2004 Goldkind ..... 2/247
2003/0115656 A1 * 6/2003 Leblang ..... 2/69
2003/0205595 A1 * 11/2003 Young ..... 224/230
2005/0015844 A1 * 1/2005 Parsons ..... 2/94
2005/0017034 A1 * 1/2005 Ausanio ..... 224/230

* cited by examiner

UTILITY PANTS FOR LAW ENFORCEMENT PERSONNEL

RELATED APPLICATIONS

None.

FIELD OF THE INVENTION

The present invention relates to the field of clothing. More particularly, the present invention relates to the field of utility pants for law enforcement personnel.

BACKGROUND OF THE INVENTION

Uniformed police officers must carry a variety of equipment for their work. A typical police officer carries a revolver, handcuffs, extra ammunition, pepper spray, a nightstick, a radio, a flashlight, keys, and other equipment. Uniformed police officers therefore usually wear utility belts for carrying this equipment, which typically weigh between 15 and 20 lbs. These utility belts are made of sturdy material such as leather, and conveniently carry the various pieces of equipment required by the police officer where the officer can quickly and easily reach them in an emergency.

Undercover police officers also carry equipment depending upon their missions and circumstances. Wearing a heavy and bulky utility belt such as worn by uniformed police officers, however, is undesirable for most undercover police work because wearing a utility belt with a gun and other visible police equipment tends to conspicuously identified the wearer as a police officer. Shoulder holsters and leg holsters provide partial solutions to the equipment carrying problems facing undercover police officers. Shoulder holsters allow an officer to carry a handgun concealed underneath a jacket such as a suit jacket, a sport coat, a winter jacket, or the like. Leg holsters allow officers to carry small handguns underneath their pant legs. Shoulder and leg holsters, however, do not solve problems associated with carrying additional equipment. Undercover police officers tend to select the equipment they wish to carry on a particular outing and place their chosen equipment in their pockets along with their keys, their wallets, and other personal items. They may carry these items in their pockets in conjunction with a gun carried in a shoulder holster or a leg holster, or simply place a gun in their pockets along with the other items in those pockets.

SUMMARY OF THE INVENTION

The inventor of the present invention has recognized the need for a more satisfactory solution to the problem of how to carry law enforcement items required by personnel such as undercover police officers. The present invention provides an effective solution to the problem of carrying certain law enforcement equipment during undercover police work such that the equipment is readily accessible, while maintaining a high degree of concealment and accompanying stealth. In the exemplary embodiment a pair of pants is provided which is made of a strong but standard fabric such as denim. In the exemplary embodiment the pants are made of blue denim, so that the pants defined a pair of blue jeans.

The jeans have a pair of hip pockets similar to the hip pockets found in a standard pair of jeans. At least partially inside one of the hip pockets is an inner pocket or handcuff pocket suitably dimensioned for carrying a pair of handcuffs. The top of the handcuff pocket rises to slightly above or slightly below the top of the corresponding hip pocket so that the officer can easily reach the handcuffs, yet the handcuffs remain largely or completely concealed from view during normal activity. A wallet or similar object may be placed in the hip pocket next to but disposed outwardly from the handcuffs, thereby concealing the outline of the handcuffs that might otherwise be visible to someone viewing the undercover officer from behind. The officer could also place a rolled up newspaper or periodical type magazine or similar object in his hip pocket, thereby completely concealing the handcuffs or other objects carried within the handcuff pocket.

The pants also have a pair of front pockets similar to the front pockets in a standard pair of jeans. At least one of these front pockets has at least one relatively deep inner pocket located therein suitably dimensioned for carrying an ammunition clip or magazine. The inner pocket is preferably deep enough so that the ammunition clip can fit completely within the inner pocket thus substantially or completely concealing the clip from view as the officer approaches a person or situation. At the same time the top of the magazine remains close enough to the top of the inner pocket so that the officer can quickly retrieve the ammunition magazine for reloading his gun when necessary.

The pants also have a long and narrow pocket on a rear side portion of the pants for carrying and concealing a baton such as a collapsible police baton. The baton within the baton pocket is disposed along the wearer's thigh such that the baton does not substantially interfere with the wearer's ability to run.

The pants further have an inner pocket sewn to the inside of the waistband or otherwise affixed thereat. The inner pocket is suitably dimensioned for carrying a handgun such that at least the top portion of the gun handle rises above the waistband so that the officer can retrieve the gun quickly when necessary.

A pair of pants can be constructed to have one or more of the features disclosed herein depending upon the officer's personal preferences and the environment expected. The pants provide a high degree of concealment of the equipment carried. For additional concealment the officer can wear a shirt out such as a dress shirt that is not tucked into his pants, such that none of the items would be visible to the casual observer.

The present invention provides a highly effective solution to the problem of carrying handcuffs, a gun, extra ammunition, a baton, and/or other equipment while completely or substantially concealing all of these items from the view of the casual observer. Because the pants are made of a typical street worn fabric such as blue denim the officer easily blends into a typical street scene. The invention therefore increases both officer safety and effectiveness.

Exemplary embodiments of the invention will be further described below with reference to the drawings, in which like numbers refer to like parts.

DETAILED DESCRIPTION OF EXEMPLARY EMBODIMENTS

Figure 1:
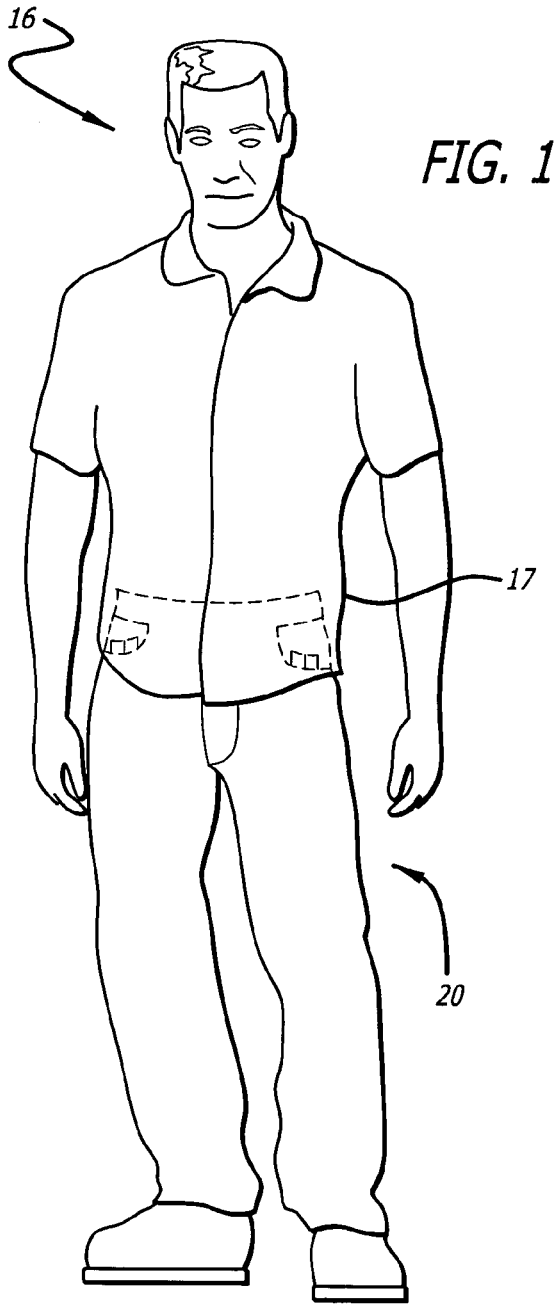
FIG. 1 is a front elevation view of an officer wearing an exemplary embodiment of the present invention, with a shirt worn out to completely conceal the items carried.

FIG. 1 is a front view of an officer 16 wearing an exemplary embodiment of the utility pants 20 of the present invention. The officer is also wearing a shirt 17 the bottom portion of which is not tucked into the officer's pants. The bottom portion of shirt 17 worn out in this matter conceals all of the equipment carried by the officer in pants 20.

Figure 2:
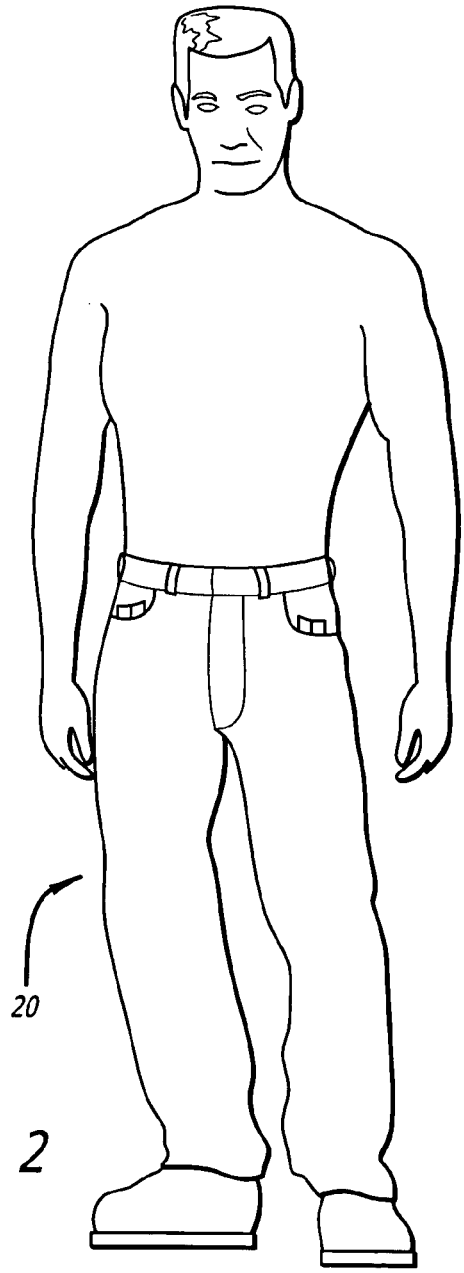
FIG. 2 is a front elevation view of the officer and pants of FIG. 1 with the officer's shirt removed.

FIG. 2 is a front view showing the officer 16 and pants 20 of FIG. 1, but shirt 17 has been removed to better reveal pants 20.

Figure 3:
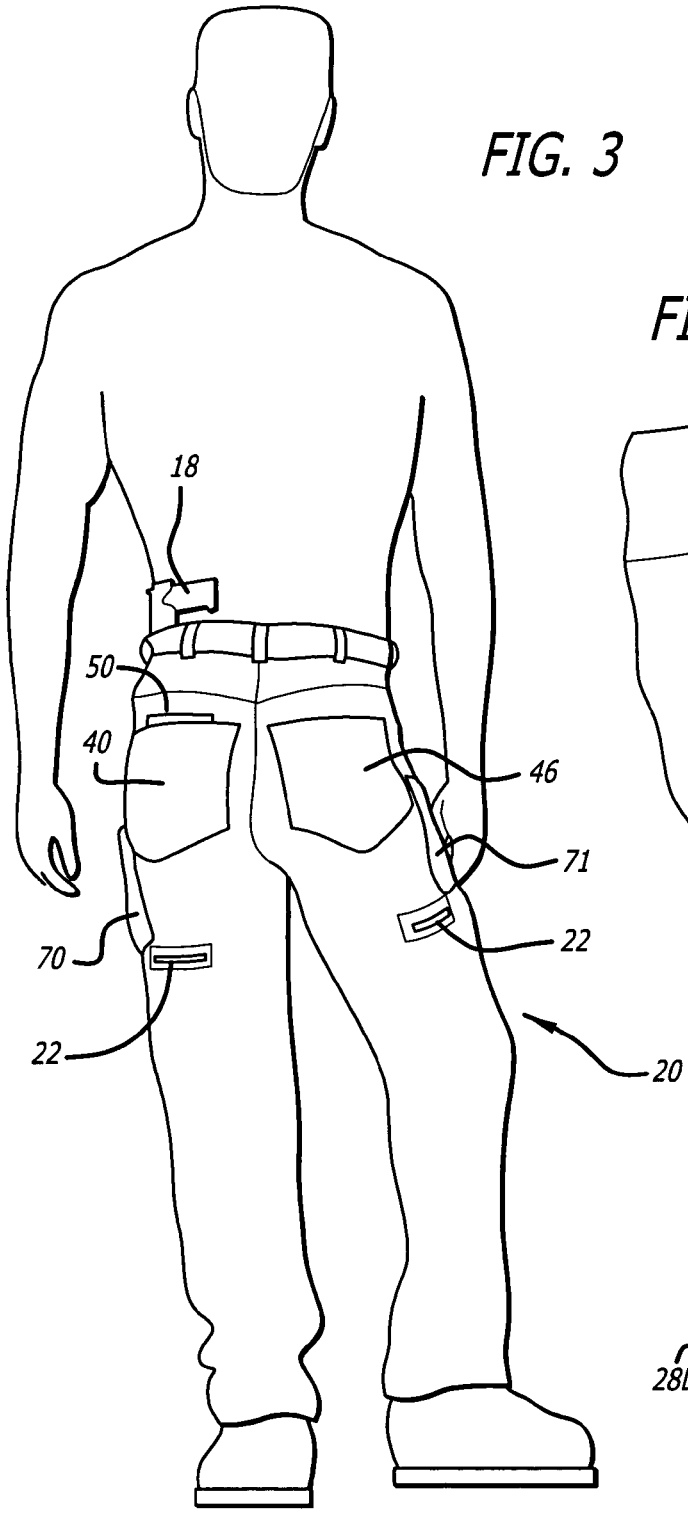
FIG. 3 is a rear elevation view of the officer and pants of FIG. 2 revealing the top of a gun carried by the officer.

FIG. 3 is a rear view showing the officer 16 and pants 20 of FIG. 1. Pants 20 include left hip pocket 40, right hip pocket 46, inner hip pocket 50, and an inner waistband pocket for carrying a handgun 18. Pants 20 also include first baton pocket 70, second baton pocket 71, and utility or welt pockets 22.

Figure 4:
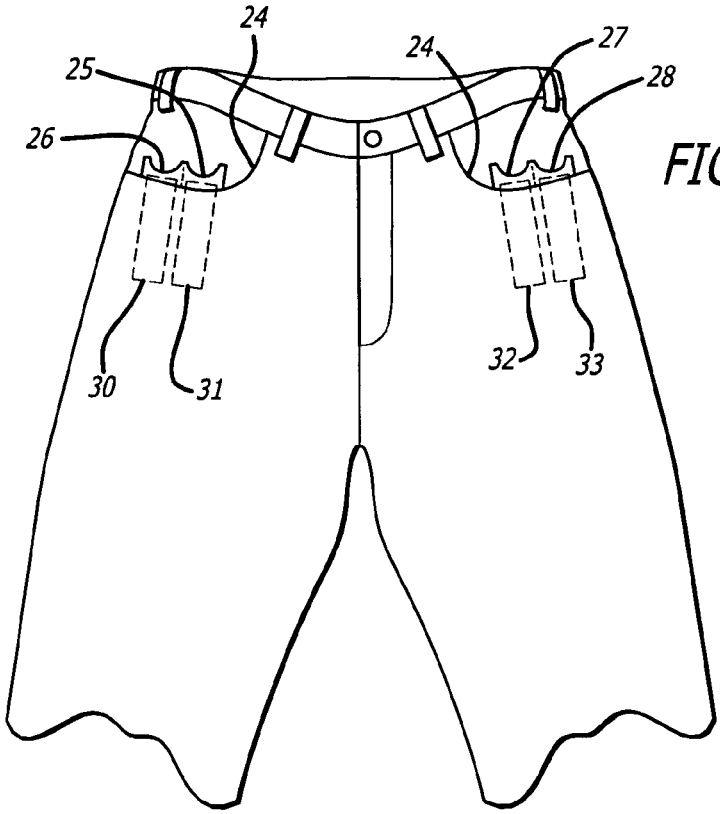
FIG. 4 is a partial cutaway front elevation view of the pants of FIG. 1 showing in phantom the ammunition magazines carried in the front inner pockets.

FIG. 4 shows the front outer pockets and front inner pockets or ammunition pockets. Front outer pockets 24 are similar to the front pockets found on most pairs of pants. Front inner pockets 25 through 28 are similar in some respects to a traditional coin pocket found on a standard pair of jeans, but are unique. The four front inner pockets are suitably dimensioned for carrying respective ammunition clips or magazines 30 through 33. In the exemplary embodiment the front inner pockets are approximately 3–4 cm long (measured in a circumferential direction along the length of the waistband), 2–3 cm wide (measured perpendicular to the waistband) and approximately 12 cm deep. Unlike traditional coin pockets, ammunition pockets 25–28 are advantageously constructed with a uniform cross-section in order to efficiently carry and hold ready for use ammunition clips 30–33. In one embodiment ammunition pockets 25–28 are deep enough so that ammunition clips 30–33 can be completely contained and concealed therein, with the tops of the ammunition clips disposed just below the tops of the ammunition pockets. In this way a casual observer might see upon careful observation that the person in front of him is wearing a slightly unusual pair of jeans, but would not see the ammunition clips. On the other hand, the ammunition clips are more quickly retrieved if at least part of the clips protrude beyond the tops of the inner pockets. Thus, if an officer were dressing for a situation in which concealment was not considered to be vital such as when serving a search warrant, the officer could place one or more small objects at the bottom of the ammunition pockets to act as shims, so that the tops of the ammunition clips when placed into the pockets on top of the shim objects would rise slightly above the tops of the ammunition pockets, thereby allowing the officer to reach and retrieve the ammunition clips even more quickly in an emergency. Alternatively, the depths of the pockets could be adjusted at manufacture such that the ammunition clips would rise a desired amount above or below the tops of the ammunition pockets. The inventor has found that having the ammunition clips rise approximately 2 mm above the tops of the ammunition pockets provides a satisfactory compromise between concealment and ready access for certain environments. Although dimensions have been given for the exemplary embodiment, those dimensions could be varied to fit various different ammunition clips. The dimensions also could vary as a tolerance or preference, for example by plus or minus 10%, 25%, or possibly as much as 50%. Although the number of ammunition pockets in the exemplary embodiment is four with two ammunition pockets being located on each side, the number of ammunition pockets is not critical. A given embodiment might have zero, one, two, three, four, or more ammunition pockets.

Figure 5:
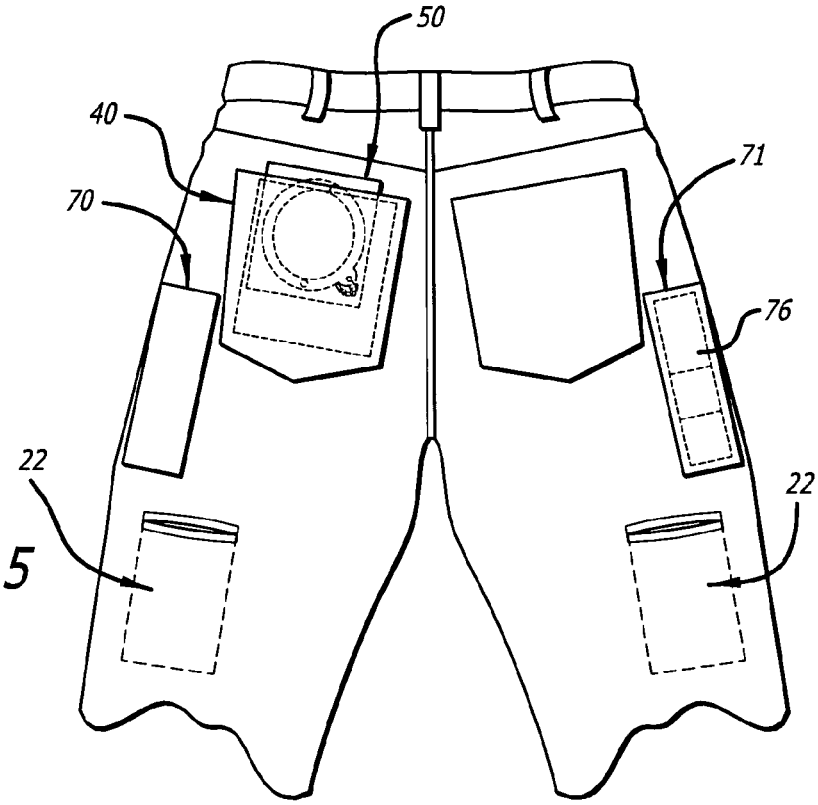
FIG. 5 is a partial cutaway rear elevation view of the pants of FIG. 1 showing in phantom the inner hip pocket, a pair of handcuffs contained therein, and a collapsible baton in the baton pocket.

FIG. 5 is a rear view of the exemplary embodiment of the pants of FIG. 4. An inner hip pocket 50 is located within outer hip pocket 40, but could be located within either the left or right hip pockets. Inner hip pocket 50 is preferably suitably dimensioned for holding a pair of handcuffs as will be described in greater detail below. The pants also preferably include two relatively long and narrow pockets 70 and 71. At least one of those pockets is suitably dimensioned for carrying a collapsible law enforcement baton 76. When placed into baton pocket 71, baton 76 rests against the thigh of the officer but does not extend upward to the point at which the thigh connects with the torso and does not extend downward to the knee. Accordingly, baton pocket 71 holds baton 76 such that the baton does not substantially interfere with the officer's ability to chase a suspect or otherwise run. The pants also preferably include at least one utility or welt pocket 22.

Figure 6:
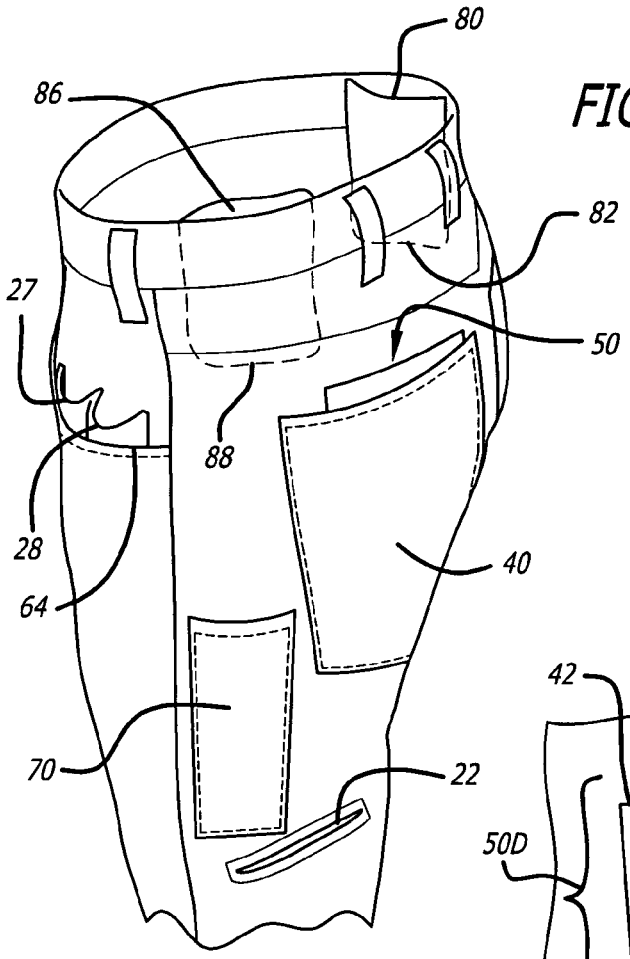
FIG. 6 is a side perspective view of the pants of FIG. 1 partially showing the inner waistband gun pockets.

FIG. 6 is a side perspective view of an illustrative embodiment of the present invention. Visible features include the top end 64 of the left front pocket 24, two ammunition pockets 27 and 28, baton pocket 70, utility pocket 22, left hip pocket 40, and inner hip pocket or handcuff pocket 50.

Also illustrated are two inner pockets 80 and 86 sewn or otherwise affixed to the inside of the waistband. Inner pockets 80 and 86 can hold additional equipment. Preferably at least one internal pocket is suitably dimensioned for carrying a handgun. As such, at least one of the pocket bottoms 82 and 86 is located such that a handgun would be securely held within pocket 80 or 86, yet the top of the handle of the handgun would extend above and beyond the waistline as illustrated in FIG. 3 so that the officer could draw his weapon relatively quickly and easily. Of course, internal pockets 80 and 86 could be used to carry items other than a gun, especially items which must be concealed from view but which the officer need not retrieve in a hurry. Accordingly, at least one of the internal pockets preferably but not necessarily is dimensioned to hold a handgun.

Figure 7:
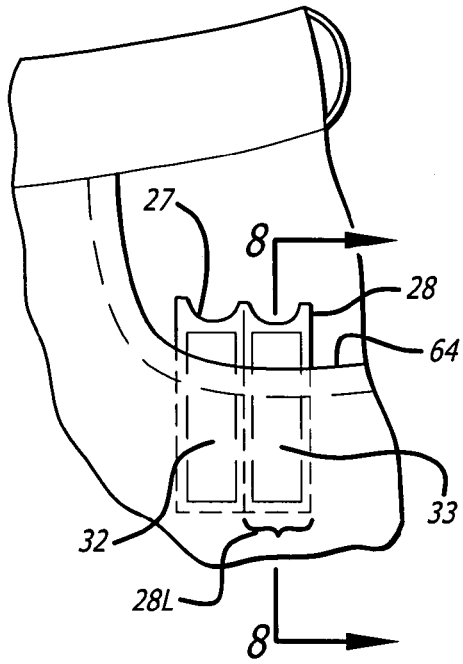
FIG. 7 is a close-up fragmentary view showing the ammunition pockets and ammunition magazines contained therein.

FIG. 7 is a close-up of the left front pocket and the two left ammunition pockets 27 and 28 shown in FIG. 4. The two front inner pockets 27 and 28 have substantially uniform cross-sections and are substantially parallel, extending vertically downward from the general area of the top 64 of the outer front pocket 24. The two inner front pockets preferably share a common vertical seam separating them. The two ammunition clips 32 and 33 located within the two front inner pockets 27 and 28 are shown in phantom.

Figure 8:
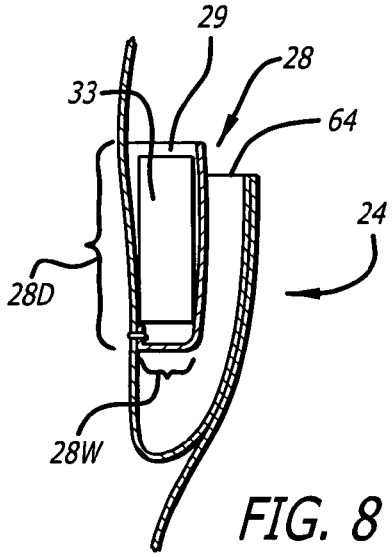
FIG. 8 is a side cutaway view of the front outer pocket, front inner pocket, and an ammunition clip taken along line 8—8 in FIG. 7.

FIG. 8 is a cross-sectional view taken along line 8—8 in FIG. 7. In the preferred embodiment shown ammunition clip 33 rests completely within inner pocket 28. The top of ammunition clip 33 rises to a level slightly below the top 29 of inner pocket 28. Preferably the top 29 of inner pocket 28 rises slightly above the top 64 of outer front pocket 24. For additional concealment, however, top level 29 of inner pocket 28 could be located slightly below top 64 of the outer front pocket. In the exemplary embodiment the front inner pocket has a length 28L of approximately 3–4 cm, a width 28W of approximately 2–3 cm, and a depth 28W of at least 6 cm, more preferably at least 8 cm, and most preferably approximately 12 cm.

Figure 9:
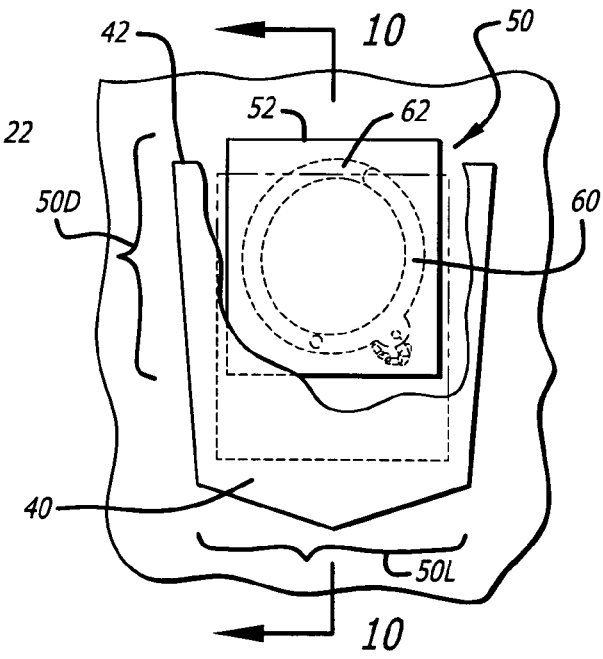
FIG. 9 is a close-up fragmentary view showing the hip pocket and inner handcuff pocket shown in FIG. 2.

FIG. 9 is a close-up showing the outer hip pocket 40 and inner hip pocket or handcuff pocket 50. The inner hip pocket 50 is disposed almost entirely within outer hip pocket 40. Inner hip pocket 50 is suitably dimensioned for carrying and concealing a pair of handcuffs 60. In the exemplary embodiment the top 52 of inner hip pocket 50 rises to slightly above the top 42 of outer hip pocket 40 allowing the officer to easily reach into inner pocket 50 and retrieve handcuffs 60. Preferably inner hip pocket 50 is suitably dimensioned such that the top edge 62 of handcuffs 60 rise slightly below top edge 52 of inner hip pocket 50 so that the handcuffs 60 are substantially or completely concealed within inner hip pocket 50. Alternatively, for additional concealment top edge 42 of outer hip pocket 40 could rise above top edge 52 of inner hip pocket 50. This configuration would make the jeans 20 appear more like a standard pair of jeans to someone observing the officer from behind. In the exemplary embodiment handcuff pocket 50 has a length 50L at least 6 cm and preferably of approximately 8.5 cm across, and a depth 50D of at least 6 cm and preferably approximately 10 cm. These dimensions could vary by plus or minus 10% or as much 25%, provided that the inner pocket is not made so narrow that handcuffs 60 will not fit therein. Alternatively, inner hip pocket 50 could be designed and used to carry objects other than handcuffs, and the dimensions of pocket 50 varied accordingly.

Figure 10:
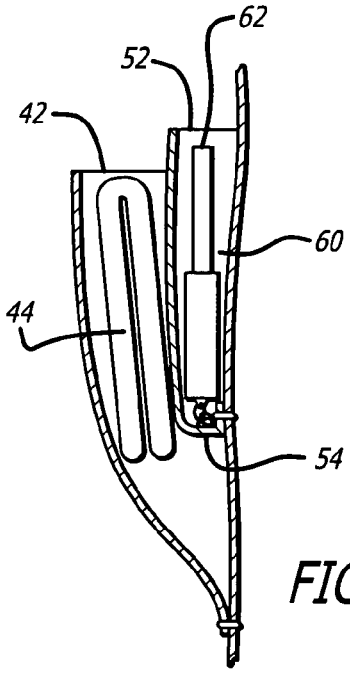
FIG. 10 is a side elevation cutaway view of the outer hip pocket and wallet therein, and inner hip pocket and handcuffs therein, taken along line 10—10 in FIG. 9.

FIG. 10 is a cross-sectional view of the inner and outer hip pockets of FIG. 9 taken along line 10—10. Handcuffs 60 and wallet 40 are shown.

It will be observed that although the hip pocket in a standard pair of jeans is large enough to hold a pair of handcuffs, the outline of the handcuffs so placed would, in many instances, be visible to an observer standing or walking behind the wearer thus tending to identify the wearer as a police officer. The present invention solves this problem by placing the handcuffs 60 within a second and inner pocket. This allows the officer to place a wallet 44 or other object in his hip pocket 40, thus substantially concealing any outline of handcuffs 60 from observers. For additional concealment the officer could place a rolled up periodical type magazine, or a rolled up or folded newspaper, a small paperback book, or any other of a wide variety of objects in his hip pocket 40 thereby completely concealing handcuffs 60 while allowing the officer to reach handcuffs 60 quickly and easily when needed.

It will be appreciated that the term "present invention" as used herein should not be construed to mean that only a single invention having a single essential element or group of elements is presented. Various features of the utility pants described and illustrated herein are believed to be new and not suggested by the prior art, either by themselves or in combination with various other features shown and described herein. Accordingly, various features illustrated and described herein and combinations thereof represent separate inventions that are not limited to the exemplary embodiments. Although the present invention has been described in detail with regard to the preferred embodiments and drawings thereof, it should be apparent to those skilled in the art that various adaptations and modifications of the present invention may be accomplished without departing from the spirit and the scope of the invention. For example, the pants can be made of any fabric that is sufficiently strong. The exact placement and dimensions of the features described and illustrated herein are not strictly necessary to the practice of the invention. Furthermore, although the invention is intended and has been described herein for use by an undercover police officer, it will be understood that the invention is not limited by the identity or occupation of the wearer or the work which he will conduct while wearing the pants. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A pair of jeans having:

first and second front pockets, each of said front pockets having respective first and second inner pockets at least partially therein thereby defining four front inner pockets, the four front inner pockets each being at least 6 cm deep;

a hip pocket, the hip pocket having a third inner pocket at least partially therein, the third inner pocket being at least 6 cm across by 6 cm deep; and a baton pocket disposed along a thigh section of the jeans, the baton pocket suitably dimensioned and positioned for carrying and concealing a police baton without substantially interfering with a wearer's ability to run.

2. The pair of jeans of claim 1 wherein said jeans are denim jeans.

3. The pair of jeans of claim 1 wherein said inner front pockets are suitably dimensioned for carrying respective ammunition magazines while substantially concealing the ammunition magazines from view.

4. The pair of jeans of claim 1 wherein said third inner pocket is suitably dimensioned for carrying handcuffs while substantially concealing the handcuffs from view.

* * * * *